United States Patent [19]

Elliott

[11] Patent Number: 4,675,687

[45] Date of Patent: Jun. 23, 1987

[54] AM-FM CELLULAR TELEPHONE MULTIBAND ANTENNA FOR MOTOR VEHICLE

[75] Inventor: James O. Elliott, Beavercreek, Ohio

[73] Assignee: General Motors Corporation, Detroit, Mich.

[21] Appl. No.: 821,438

[22] Filed: Jan. 22, 1986

[51] Int. Cl.[4] ..... H01Q 1/10

[52] U.S. Cl. ..... 343/715; 343/722; 343/903

[58] Field of Search ..... 343/713–715, 343/722, 745, 749–752, 825, 827, 829, 831, 843, 845, 901, 903

[56] References Cited

U.S. PATENT DOCUMENTS

| | | | |
|---|---|---|---|
| 1,783,025 | 11/1930 | Meissner | 343/749 |
| 2,648,771 | 8/1953 | Cork | 343/750 |
| 2,898,590 | 8/1959 | Pichitino | 343/722 |
| 3,172,109 | 3/1965 | Senrui | 343/749 |
| 3,445,849 | 5/1969 | Sanford | 343/702 |
| 4,041,498 | 8/1977 | Freimark et al. | 343/749 |
| 4,095,229 | 6/1978 | Elliott | 343/715 |
| 4,117,493 | 9/1978 | Altmayer | 343/750 |

FOREIGN PATENT DOCUMENTS

| | | | |
|---|---|---|---|
| 168702 | 9/1984 | Japan | 343/901 |

*Primary Examiner*—William L. Sikes
*Assistant Examiner*—Michael C. Wimer
*Attorney, Agent, or Firm*—Robert M. Sigler

[57] ABSTRACT

An AM-FM-cellular telephone multiband antenna adapted for mounting on a motor vehicle fender includes, connected collinearly in order from the bottom, a first mast section having a length of one quarter wavelength at a first frequency near 835 MHz in the cellular telephone band, a phasing coil having an electrical length of one half wavelength at the first frequency, a second mast section having a length of one half wavelength at the first frequency, a trap coil resonant at the first frequency and a third mast section. The trap coil isolates the second and third mast sections at the first frequency so that the phasing coil and second mast section adding gain to the first mass section in cellular telephone reception at frequencies near the first frequency. However, the trap coil connects the second and third mast sections to provide a tuned quarter wavelength antenna at a second frequency in the FM radio band while providing reception at frequencies in the AM radio band. The antenna is especially suited for power telescoping operation.

2 Claims, 2 Drawing Figures

AM-FM CELLULAR TELEPHONE MULTIBAND ANTENNA FOR MOTOR VEHICLE

BACKGROUND OF THE INVENTION

This invention relates to an antenna for a motor vehicle which is capable of full duplex operation in the cellular telephone frequency band of 825–890 MHz and is also effective to receive normal commercial AM and FM broadcasts. It is especially directed toward such an antenna adaptable for power telescoping operation from a fender of the vehicle.

Commercially available antennas for vehicle mounted cellular telephones are generally separate antennas adapted for operation from the roof of the vehicle. However, it is physically difficult to mount and connect an antenna on a vehicle roof. Also, with a separate AM-FM antenna, the resulting multiplicity of antennas is considered by many to be unattractive in appearance. Finally, many motorists prefer a power antenna which retracts when not in use and is thus less subject to accidental damage and vandalism. Such an antenna cannot be mounted in the roof; but is more suited for mounting in the vehicle fender, where there is room for the retracted antenna parts.

SUMMARY OF THE INVENTION

An AM-FM-cellular telephone multiband antenna which is adapted for power telescoping operation and allows AM, FM and full duplex cellular telephone operation by a single, multiband unit from a vehicle fender comprises a first mast section having a length of one quarter wavelength at a first frequency near 835 MHz in the cellular telephone band, a phasing coil connected collinearly above the first mast section and having an effective electrical length of one half wavelength at the first frequency, a second mast section connected collinearly above the phasing coil and having a length of one half wavelength at the first frequency, a trap coil connected collinearly above the second mast section, the trap coil having an inductance and a capacitance providing resonance at the first frequency, and a third mast section connected collinearly above the trap coil and having a length effective, when not isolated from the second mast section, to produce resonance at a second frequency in the FM band, the trap coil being effective to isolate the third mast section from the second mast section at the first frequency and thus, with the second mast section, adding gain to the first mast section in cellular telephone operation at frequencies near the first frequency but being further effective to connect the third mast section to the second mast section for tuned resonant reception at FM frequencies and for reception at AM radio frequencies. Further details and advantages will be apparent from the accompanying drawings and following description of a preferred embodiment.

DESCRIPTION OF THE PREFERRED EMBODIMENT

Figure 1:
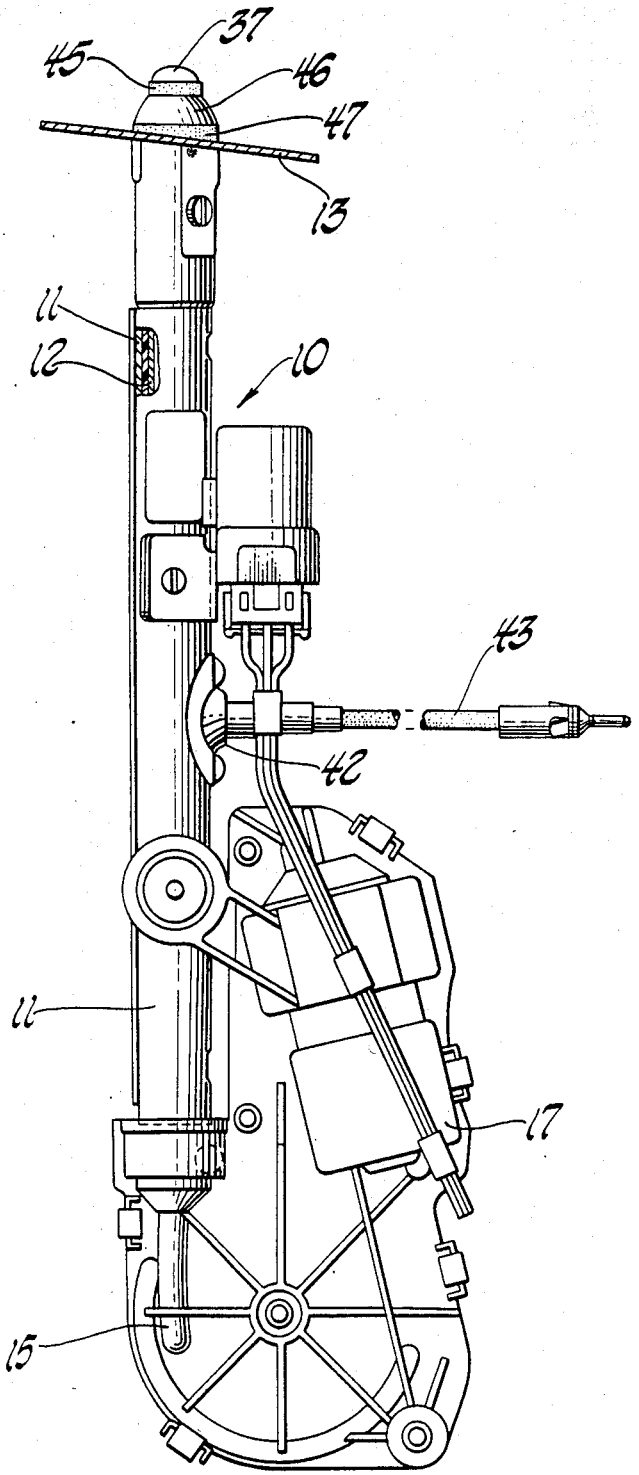
FIG. 1 is an elevational view of a power telescoping embodiment of the antenna of this invention in its fully retracted state.

Referring to FIG. 1, a power antenna assembly 10 includes a shield tube 11 having attachment means, to be described below, adapted to physically connect the top thereof to a surface of a vehicle fender 13. The word fender as used in this description and the following claims is intended to be broadly interpreted to mean any of the front or rear fenders or similar surfaces of the vehicle. A fixed mast version of the antenna could, of course, be mounted on the vehicle roof or trunk lid, if desired; but such mounting would be impractical for the power telescoping version for the obvious reason that the shield tube and drive apparatus must be placed below the vehicle mounting surface. The bottom of the shield tube is open to a cable guide 15 containing a drive cable, not shown. The cable guide 15 and cable extend to a reversible DC electric motor and winding drum unit 17. The cable, drum and motor portion of assembly 10 is conventional and described in detail in the literature, so further description of these elements will not be given here.

Figure 2:
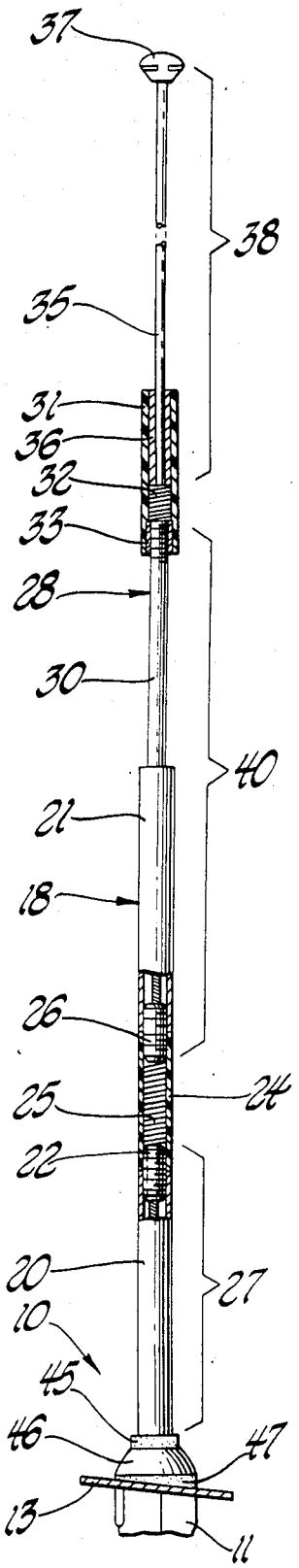
FIG. 2 is an elevational view of the fully extended portion of the antenna of FIG. 1 which projects out of the shield tube.

Situated coaxially within shield tube 11 of FIG. 1 is a fixed tube 12, also electrically conducting and insulated from shield tube 11. Telescoped therein are a plurality of mast members, which will be identified with reference to FIG. 2, wherein they are shown fully extended. A first mast tube 18 of outer diameter 0.40 inch (1.02 cm) is smaller in diameter than fixed tube 12, physically and electrically in contact with fixed tube 12 and adapted to slide therein between retracted and extended positions, the latter shown in FIG. 2. First mast tube 18 comprises a lower portion 20, made of an electrically conducting metal 3.00 inches (7.62 cm) long, the top 0.375 inch (0.95 cm) of which is internally threaded. Appropriate electrically conducting metals for mast tube 18 and other metal parts of this antenna include stainless steel, chrome plated brass or other common antenna materials.

First mast tube 18 further comprises an upper portion 21 also made of the electrically conducting metal and internally threaded at its lower end. Upper portion 21 is 3.48 inches (8.84 cm) long. Between upper portion 21 and lower portion 20 is a middle portion 24 made of a thermoplastic resin such as Celcon (R), which has desirable dielectric properties and colored to match the metal parts as closely as possible. Within middle portion 24 is a coil assembly comprising a phasing coil 25 and two threaded, electrically conducting, metal tubes 22 and 26. Phasing coil 25, which has an equivalent electrical length, at 835 MHz, of one half wavelength, has a physical length of 1.50 inches (3.81 cm) and is essentially centered axially within the 2.0 inches (5.08 cm) of middle portion 24. Metal tube 26 is soldered at its lower end to the top of coil 25 and projects upward out of middle portion 24 into upper portion 21. Metal tube 22 is soldered at its upper end to the lower end of coil 25 and projects downward out of middle portion 24 into lower portion 20. Tubes 22 and 26 serve to hold the assembly of first mast tube 18 together and further provide a continuation of the antenna conducting path from the metal portions 20 and 21 to coil 25 within the plastic middle portion 24. The lower portion 20 and conducting metal tube 22 comprise a first mast section 27 of length 3.25 inches (8.25 cm) which forms the lowest part of the antenna and is connected collinearly with phasing coil 25.

A second mast tube 28 of 0.20 inch (0.51 cm) outer diameter is adapted to telescope with sliding physical and electrical contact within upper portion 21 of first mast tube 18. A first portion 30 of second mast tube 28, which projects above the top of first mast tube 18 when the antenna is fully extended, is made of conducting metal and measures 2.44 inches (6.21 cm). A second portion 31 of second mast tube 28 is of larger diameter and made of Celcon (R) or an equivalent thermoplastic resin with an internal trap coil 32 soldered at its lower end to a 0.367 inch (0.93 cm) long, internally threaded, conducting metal tube 33 and, at its upper end, to a 1.07 inch (2.72 cm) long, conducting metal tube 36, both within portion 31 of second mast tube 28. Coil 32 itself is 0.50 inch (1.27 cm) long and has parallel capacitance and inductance which resonate at 835 MHz. Tube 26, upper portion 21 of first mast tube 18, first portion 30 of second mast tube 28 and tube 33 together comprise a second mast section 40 of length 6.5 inches (16.51 cm), which is one half wavelength at 835 MHz, connected collinearly between coils 25 and 32.

A mast rod 35 is made of 0.10 inch (0.25 cm) diameter electrically conducting metal and is adapted to telescope within second mast tube 28 when retracted but is collinearly connected by sliding physical contact with tube 36 to the top of coil 32 and physically projects out of second mast tube 28 when fully extended. The lower end of rod 35 is physically connected to the drive cable for extension and retraction of the antenna moveable elements within shield tube 11. The top of rod 35 includes a finial or corona button 37, which also acts as a water seal when the antenna is retracted. The extended rod 35 and the tube 36 of second mast tube 28 comprise a third mast section 38 connected collinearly above coil 32 at frequencies removed from 835 MHz. The physical length of the extended rod 35 is 10.94 inches (27.79 cm); and the additional 1.07 inches (2.72 cm) of tube 36 provides a total physical length for the third mast section 38 of 12.01 inches (30.51 cm).

The three mast sections and two coils of the antenna work together in three different ways during operation in the three frequency bands assigned to cellular telephone, commercial FM and commercial AM. In the cellular telephone frequency band, full duplex operation is obtained with vehicle transmission in a lower band of 825–845 MHz and fixed station transmission in an upper band of 870–890 MHz. At the center of the vehicle transmission band, 835 MHz, the antenna is a gain antenna with a lower quarter wavelength element comprising first mast section 27 connected collinearly through phasing coil 25 to an upper half wavelength radiating element, second mast section 40. The half wavelength electrical length of phasing coil 25 assures currents in phase in first and second mast sections 27, 40 to provide a 3 db gain over an antenna with a quarter wavelength element alone. The resonance of coil 32 at 835 MHz effectively removes it and the third mast section 38 from the antenna at frequencies in the cellular telephone band. The antenna is optimized for the center of the vehicle transmission band because this is the most critical band for transmission, due to the physical limitations (power, size) of the vehicle mounted system.

At frequencies in the FM band, coil 32 and third mast section 38 become active in the antenna, which is resonant at a frequency of approximately 95 MHz in the FM band. This is due to mast contributions of 3.25, 6.5 and 12 inches from the first, second and third mast sections along with an effective 6.5 inches from the phasing coil and an extra inch or two from the trap coil for a total equivalent electrical length of approximately 29.25 inches (74.3 cm). Since the antenna is actually physically shorter than its equivalent electrical length, its resistive impedance will not be optimized at 50 ohms, but the effective quarter wavelength resonance will cancel the reactance at the resonant frequency to provide good FM performance at a slightly reduced efficiency. Thus, good cellular telephone performance and FM performance are both obtained from a power telescoping antenna.

The antenna further provides reception in the commercial AM band. The total effective electrical length of the antenna at commercial AM frequencies corresponds to its physical length, which is approximately 23.76 inches (60.35 cm). This is long enough for reasonable AM reception, particularly in strong signal areas.

The signal is conducted away from the bottom of the antenna by a coaxial transmission line to a splitter, not shown, which isolates the AM-FM entertainment radio receiver from the cellular telephone apparatus. The splitter allows the cellular telephone to be used simultaneously with the entertainment radio without signal confusion.

In the case of a fixed antenna, the transmission line may be a cable fitted to a connector at the bottom of the first mast member in the normal manner. However, in the case of the power telescoping antenna, this is not possible, since the shield tube and drive apparatus are in the way. Therefore, shield tube 11 is grounded and fixed tube 12 is used with shield tube 11 as a transmission line connector, with a coaxial feed connector 42 providing a connecting point for the center conductor of a coaxial cable 43 through the side of shield tube 11 to fixed tube 12 and a connection of the outer conductor of coaxial cable 43 to shield tube 11. However, connector 42 must be carefully placed along shield tube 11, since a wavelength at 835 MHz is only 13 inches or 33 cm, which is the same order of magnitude as the shield tube itself. The process is complicated by the fact that the portion of the fixed and shield tubes below the feed point acts as an open stub which reflects a reactance back to the feed point. It is necessary to find a feed point wherein a reactive load of one type, such as inductive, from the stub, is cancelled by a reactive load of the opposite type, such as capacitive, in parallel from the transmission line connection to the antenna. In addition, when the reactive effects cancel, the purely resistive impedance remaining should be optimized, if possible, at fifty ohms. Since the total length of the shield tube 11 and the fixed tube within it is fixed, the stub and transmission line change length in equal and opposite directions as the feed point is varied. For any given apparatus of shield tube, fixed tube and dielectric insulator there is a feed point wherein the reactances cancel. However, the resistance may not be optimum. Thus some property of the shield tube, fixed tube or dielectric is varied to improve the resitance while the feed point is simultaneously varied to maintain cancellation of the reactances. Those skilled in the art will know how to calculate the optimum feed point according to the principle described above. In the embodiment shown, the feed point turns out to be slightly more than one half wavelength at 835 MHz down from the top of the shield tube.

At the junction of the shield tube 11 and fender 13, an insulating tube 45, having an externally threaded portion, projects upward from shield tube 11 through an opening in fender 13. This tube has internal sealing means to prevent water from entering shield tube 11 with the antenna extended. It also provides the means for a nut 46 to screw down against an insulating wedge 47 to hold shield tube 11 tight against the underside of fender 13 for grounding. Tube 45 and wedge 47 are insulators in order to electrically insulate tube 18 of the antenna from the ground potential of fender 13 and shield tube 11 while minimizing the antenna's capacitance to ground, which could otherwise be highly deleterious to the antenna's performance at 835 MHz.

The embodiments of the invention in which an exclusive property or privilege is claimed are defined as follows:

1. An AM-FM-cellular telephone multiband antenna adapted for mounting on a motor vehicle fender, the antenna comprising, in combination:

a first mast section having a length of one quarter wavelength at a first frequency near 835 MHz in the cellular telephone band;

a phasing coil connected collinearly above the first mast section and having an effective electrical length of one half wavelength at the first frequency;

a second mast section connected collinearly above the phasing coil and having a length of one half wavelength at the first frequency;

a trap coil connected collinearly above the second mast section, the trap coil having an inductance and a capacitance providing resonance at the first frequency;

a third mast section connected collinearly above the trap coil and having a length effective, when not isolated from the second mast section, to produce resonance at a second frequency in the FM band, the trap coil being effective to isolate the third mast section from the second mast section at the first frequency, whereby the phasing coil and second mast section add gain to the first mast section in cellular telephone reception at frequencies near the first frequency, the trap coil being further effective to connect the third mast section to the second mast section for resonance at FM frequencies and for reception at AM radio frequencies.

2. A power telescoping AM-FM-cellular telephone multiband antenna adapted for mounting on a motor vehicle fender, the antenna comprising, in combination:

an electrically conductive shield tube extending downward into the motor vehicle from the exterior surface of the fender;

an electrically conductive fixed tube within the shield tube and electrically insulated therefrom;

a first mast tube adapted to contact and telescope in and out of the fixed tube, the first mast tube including an electrically conducting lower portion comprising a first mast section having a total length when fully extended out of the shield tube of one quarter wavelength at a first frequency near 835 MHz in the cellular telephone band, an electrically insulating middle portion and an electrically conducting upper portion;

a phasing coil in the middle portion of the first mast tube above the first mast section and connected collinearly therewith, the phasing coil having an effective electrical length of one half the wavelength at the first frequency;

a second mast tube adapted to contact and telescope in and out of the upper portion of the first mast tube, the second mast tube including an electrically conducting lower portion comprising, along with the upper portion of the first mast tube, a second mast section having an electrical length of one half wavelength at the first frequency, the second mast tube further including an electrically insulating upper portion;

a trap coil in the upper portion of the second mast tube above the second mast section and connected collinearly therewith, the trap coil having an associated inductance and capacitance providing resonance at the first frequency;

a contact element in the upper portion of the second mast tube above the trap coil and connected collinearly therwith;

a mast rod adapted to contact the contact element and telescope in and out of the second mast tube, the mast rod and contact element together comprising a third mast section connected collinearly above the trap coil and having an electrical length, when added to the electrical lengths of the first mast section, phasing coil, second mast section and trap coil, equal to one quarter wavelength at a second frequency in the FM frequency band, the trap coil being effective, in resonance, to isolate the second and third mast sections and thus create a gain antenna from the first and second mast sections and phasing coil at the first frequency and further effective to connect the second and third mast sections for operation at frequencies in the AM frequency band;

a coaxial antenna feed connected to the fixed and shield tubes for coaxial communication through the fixed and shield tubes to the lower end of the first mast tube, the feed being located in the side of the fixed and shield tubes at a distance below the lower end of the first mast tube such that the transmission line reactance of the fixed and shield tubes from the feed to the first mast tube cancels the stub reactance of the fixed and shield tubes below the feed, as reflected back to the feed; and power means selectively activatable to telescope the antenna in and out of the fixed tube.

* * * * *